United States Patent [19]

Avera

[11] Patent Number: 4,946,715

[45] Date of Patent: Aug. 7, 1990

[54] METHOD FOR PRODUCING FAUX FINISHES ON NON-POROUS SURFACES

[76] Inventor: Ronald T. Avera, 706 Mockingbird, Pasadena, Tex. 77502

[21] Appl. No.: 217,562

[22] Filed: Jul. 11, 1988

[51] Int. Cl.[5] ..... B05D 5/00; B05D 1/02; B05D 3/00

[52] U.S. Cl. ..... 427/273; 427/274

[58] Field of Search ..... 427/268, 273, 274, 257, 427/263, 281

[56] References Cited

U.S. PATENT DOCUMENTS 835,213 11/1906 Bösken ..... 427/263
2,610,578 9/1952 Paasche ..... 118/314 X
3,202,527 8/1965 Stevens ..... 427/263 X
3,293,063 12/1966 Pohl et al. ..... 427/263

OTHER PUBLICATIONS

Burrell, H., "A Survey of Novelty Finishes," *Organic Finishing,* Dec. 1955, pp. 17–19.

*Primary Examiner*—Evan Lawrence
*Attorney, Agent, or Firm*—Pravel, Gambrell, Hewitt, Kimball & Krieger

[57] ABSTRACT

A method for producing a faux finish on a non-porous surface, such as metal, by applying a coating of wet paint to the surface, immediately spattering the surface with solvent, and inducing the wet paint to flow randomly on the surface before drying.

18 Claims, No Drawings

METHOD FOR PRODUCING FAUX FINISHES ON NON-POROUS SURFACES

FIELD OF THE INVENTION

This invention relates to a method for producing a product having a faux finish. More particularly, it relates to a method for producing a faux finish on a non-porous surface, such as metal molding used in framing pictures.

BACKGROUND OF THE INVENTION

In the art of picture framing, solid color metal molding has been used for many years, and it is associated with low cost framing that is not regarded in the industry as aesthetically pleasing. No one has ever produced metal molding having a pattern, let alone a faux finish, because the labor required to produce such finishes would make the product prohibitively expensive.

The art of creating faux finishes, such as marble, has been practiced for centuries. There are essentially two methods known for the production of faux finishes, namely, the positive and negative methods. These methods are described in Isabel O'Neil, *The Art of the Painted Finish for Furniture & Decoration* (1971). The term "positive" describes those processes in which the marble pattern is created by direct application of the paints to the surface to be decorated. Positive methods include flooding the surface with a base color and applying other colors, in a pattern, to the wet base-colored surface. Another positive method includes laying the floating colors on a dry surface and inducing them to flow with a spattering of mineral spirits.

O'Neil also describes the negative method which involves the creation of a marble-like pattern by the partial removal of paint. This method involves a surface which has been shellacked. The surface is coated with flatting oil and coated again with japan paint thinned with flatting oil and mineral spirits. The marble finish is actually created by laying newspaper over the piece to absorb the colors.

Other references that describe faux finishes include Jocasta Innes, *Paint Magic* (rev'd. ed. 1987) which teaches a positive method of applying a faux marble finish to woodwork and floors by adding colors to a prepared surface. Mitchell, in U.S. Pat. No. 4378,387, discloses a method for superimposing marble patterns one upon the other on a flat surface, such as a paper surface. Briefly, the method entails floating and combining several colors of ink to create an ink film upon a surface of a liquid with which the ink is not miscible and contacting the paper surface with this ink film.

Shemenski, in U.S. Pat. No. 4,508,736 discloses a method for producing a pattern (not necessarily marble-like) upon a cylindrical, non-porous body such as a pen. The method includes spraying a first coat of lacquer onto the object, curing this coat, and then rolling the object along a textured patterning pad which applies a second coat. A hard, resinous, protective coating may be applied over the dried second coat.

Both O'Neil and Innes describe methods of producing a faux marble finish on surfaces that are absorbent (porous), such as wooden furniture and floor. Also, both describe methods that use only simple tools, such as brushes, paper, feathers and are thus labor-intensive. Mitchell is similarly directed toward a manual method of coating flat sheets such as paper. Shemenski, while applying a coat to a non-porous surface, is limited to cylindrical surfaces, such as pens, which can roll over the patterning pad for the application of the second coat. Significantly, in Shemenski's method, the object is physically rolled over a patterning pad which applies a second coat of paint. From the examples, it is readily apparent that Shemenski's method is also "annual" and labor-intensive.

In the manufacture of metal molding, the substrate is typically line fed through a spray painting machine, and a uniform coat of oil-based paint is applied. The line speed of this operation, which is usually over 200 feet per minute, does not permit the use of these known methods of creating faux finishes. There exists a need for an inexpensive, non-labor intensive method of applying a faux finish to a non-porous surface, such as a metal molding suitable for use in picture framing, which can be rapidly applied to keep pace with commercial production

SUMMARY OF THE INVENTION

The present invention describes an automated, inexpensive method of applying a faux finish, such as marble, onto a non-porous substrate, such as metal molding. In its preferred embodiment, the invention includes the use of a spray painting machine which is equipped with at least two spray nozzles. The first spray nozzle applies a thin coating of oil-based paint onto a continuously fed substrate while the second spray nozzle immediately downstream is adapted to apply a non-uniform coating or spattering of solvent. The spattering of solvent causes the wet paint to vary in viscosity which allows the paint to flow randomly and produce a faux finish. After drying, a coating, such as lacquer, may be applied to the decorated surface to provide protection for the faux finish.

DESCRIPTION OF THE PREFERRED EMBODIMENTS

The method of this invention produces a faux finish, such as marble, on a non-porous surface. In order to practice this method, a substrate, e.g., metal molding, is coated with an oil-based paint. This paint is induced to flow randomly by spattering a solvent, such as turpentine, on the surface of the freshly painted substrate.

Since a solvent or paint thinner acts to decrease the viscosity of wet paint, it can cause paint to run on the surface of a substrate. Spattering the solvent in a non-uniform manner causes the paint coating to vary in viscosity. This variance in viscosity of the wet paint makes the paint flow unevenly, creating a faux finish when dried. After the substrate is dried, it can be further treated with a coating, e.g., lacquer, to protect the faux finish.

Several factors will affect the faux finish. One of these factors is the line speed of the substrate. In order to create a product having a consistent faux finish, the line speed should be maintained at a fairly constant rate while preparing a particular lot. In addition, the rate of application and type of paint and solvent used will affect the faux finish. Therefore, it may be necessary to adjust these variables to achieve an aesthetically pleasing product.

Another factor that will affect the faux finish is the drying time. Since the paint flow is a function of time, the drying step should be closely controlled to provide for a consistent faux finish. One way to control the drying step would be to maintain a fixed temperature and humidity. Of course, drying ovens can be used to accelerate the drying step, if desired. One skilled in the art will be able to easily determine the appropriate drying time for a particular paint and solvent.

The solvent which is spattered on the wet painted substrate alters the viscosity of the paint and allows the paint to flow in a random pattern. Care should be taken not to apply an excessive amount of solvent because the wet paint could flow completely off the substrate. One skilled in the art will be able to readily determine the rate and volume of solvent to apply to the painted substrate to create a faux finish, such as marble.

The actual flow of the wet paint may be induced by any appropriate means, e.g., gravity or blown air. For instance, in the preferred embodiment, a curved metal substrate would be coated with paint and immediately spattered with solvent. The finished product would be removed from the apparatus and allowed to air dry or heat could be applied to speed the drying time. The effect of gravity would cause the wet paint to flow randomly on the curved surface during the drying step, creating a faux finish. After the product is dried, it would be coated with a clear coating, same as lacquer, to protect the faux finish.

The preferred method of this invention employs a machine equipped with (1) a means for feeding a length of the substrate to be decorated, (2) at least one spray nozzle adapted to apply a coating of wet oil-based paint on the substrate, and (3) at least one spray nozzle immediately downstream from the paint spray nozzle adapted to apply a non-uniform coat of solvent onto the wet painted substrate, i.e., spatter the solvent onto the substrate.

An automatic molding sprayer that can be adapted to perform this method is commercially available. For example, American Machine Corp. in Van Nuys, Calif. offers a model LSP-2600-M which has two spray nozzles. This machine is designed to apply spray paint to a substrate through both nozzles, but it can be altered to apply paint through the first nozzle and a non-uniform coat of solvent through the second nozzle. Normally, the air to paint pressure ratio in a paint spray system is about 40 psi air to 5 psi liquid. This ratio may vary according to the manufacturer's design. The effect of this pressure ratio is to atomize the paint so as to apply a fairly uniform coating.

In the solvent spray system, the pressure ratio is adjusted to cause the solvent to spatter so as to apply a non-uniform coat of solvent. The air to solvent pressure ratio in the solvent spray system may vary from about 3–10 psi air to 20–80 psi solvent. The preferred air to solvent pressure ratio of the solvent spray system is about 7 psi air to 40 psi solvent. The preferred solvent used in this method is turpentine, but any oil-based paint solvent, such as mineral spirits, toluene or methylethylketone, may be used. The solvent is applied while the paint is still wet, preferably within about 10 to 15 seconds after the paint is applied.

The rate of feed for the substrate may also be adjusted in conjunction with the rate of application of paint and solvent to vary the faux finish. The typical line speed of model LSP-2600-M from American Machine Corporation is 220 feet per minute. The paint employed in this method is any type of oil-based paint suitable for application onto a non-porous substrate.

Of course, the manner in which the paint is applied is not critical since the paint will be induced to flow. Therefore, it is possible to practice this method by rolling or brushing the paint onto the substrate, although these methods are not preferred. Likewise, any manner of applying a spattering of solvent should provide the same effect.

In the most preferred embodiment, a pre-painted metal molding is used as the substrate. This pre-painted substrate is not affected by the method of this invention, but the color of the pre-painted substrate forms the base color of the faux finish. For example, a red-colored metal molding can be used as the substrate, and white paint can be applied by the method of this invention. The spattered solvent will cause the white paint to run unevenly across the surface of the red-colored substrate. The finished product will have a red base color with streaks of white forming the faux finish. Obviously, the color of the substrate and the color of the paint used in this method affects the color of the faux finish, and an infinite variety of faux finishes are possible.

The principal of the invention and the best mode contemplated for applying that principle have been described. It is to be understood that the foregoing is illustrative only and that other means and techniques can be employed without departing from the true scope of the invention defined in the following claims.

What is claimed is:

1. An automated method for producing a faux marble finish on a non-porous substrate, comprising the steps of:

(a) feeding said substrate at a substantially constant rate through a coating apparatus;

(b) coating said substrate with at least one oil-based paint to provide a wet painted surface;

(c) immediately thereafter spattering onto said wet painted surface a non-uniform coating of solvent for said paint;

(d) inducing at least some of the wet paint spattered with the solvent to flow randomly on said surface thereby creating said finish; and (e) drying said paint on said surface.

2. The method of claim 1, wherein said non-porous substrate is metal.

3. The method of claim 1, wherein said paint is sprayed onto said substrate.

4. The method of claim 1, wherein said solvent is spattered onto said wet painted surface by means of air pressure.

5. The method of claim 4, wherein the air to solvent pressure ratio is from about 3–10 psi air to about °–80 psi solvent.

6. The method of claim 5, wherein said air to solvent pressure ratio is about 7 psi air to about 40 psi

7. The method of claim 1, wherein said non-porous substrate is painted with a base color which is dried prior to performing step (a).

8. The method of claim 1, further comprising the step of coating said surface with a clear positive coating after said paint has dried.

9. An automated method for producing a flux marble finish on metal molding comprising:

(a) feeding said metal molding at a substantially constant rate through a coating apparatus;

(b) coating said molding with at least one oil-based paint to provide a wet painted surface;

(c) immediately thereafter spattering onto said wet painted surface a non-uniform coating of solvent for said paint;

(d) inducing at least some of the wet paint spattered with the solvent to flow randomly on said surface thereby creating said finish; and (e) drying said paint on said surface.

10. The method of claim 10, wherein said paint is sprayed onto said surface.

11. The method of claim 9, wherein said solvent is spattered onto said wet painted surface by means of air pressure.

12. The method of claim 9, wherein the air to solvent pressure ratio is from about 3–10 psi air to about 20–80 psi solvent.

13. The method of claim 9, wherein said air to solvent pressure ratio is about 7 psi air to about 40 psi solvent.

14. The method of claim 9, wherein said metal molding is painted with a base paint which is dried prior to performing step (a).

15. The method of claim 9, further surprising the step of coating said surface with a clear protective coating after said paint has dried.

16. An automated method for producing a faux marble finish on a metal molding, comprising:

(a) feeding said molding at a substantially constant rate through a coating apparatus which has at least two in-line spray nozzles;

(b) coating said molding at a first nozzle with at least one oil-based paint to provide a wet painted surface;

(c) immediately thereafter spattering onto said wet painted surface at a second in-line nozzle a non-uniform coating of solvent for said paint;

(d) inducing at least some of the wet paint spattered with the solvent to flow randomly on said surface thereby creating said finish; and (e) drying said paint on said surface.

17. The method of claim 16, wherein said metal molding is painted with a base paint which is dried prior to performing step (a).

18. The method of claim 17, further comprising the step of coating said surface with a clear protective coating after said paint has dried.

* * * * *

UNITED STATES PATENT AND TRADEMARK OFFICE

CERTIFICATE OF CORRECTION

PATENT NO. : 4,946,715

DATED : August 7, 1990

INVENTOR(S) : Ronald T. Avera

It is certified that error appears in the above-identified patent and that said Letters Patent is hereby corrected as shown below:

At column 3, line 23, change "same" to --such--.

In claim 9, column 4, line 1, change "flux" to --faux--.

In claim 15, column 5, line 1, change "surprising" to --comprising--.

Signed and Sealed this

Fourth Day of February, 1992

*Attest:*

HARRY F. MANBECK, JR.

*Attesting Officer*

*Commissioner of Patents and Trademarks*